US007757897B2

(12) United States Patent
Young et al.

(10) Patent No.: US 7,757,897 B2
(45) Date of Patent: Jul. 20, 2010

(54) DISPENSING PUMP

(75) Inventors: Peter A. Young, Oxfordshire (GB); Francesco Brambilla, Parma (IT)

(73) Assignee: Obrist Closures Switzerland GmbH, Reinach (CH)

( * ) Notice: Subject to any disclaimer, the term of this patent is extended or adjusted under 35 U.S.C. 154(b) by 446 days.

(21) Appl. No.: 11/575,661

(22) PCT Filed: Sep. 23, 2005

(86) PCT No.: PCT/EP2005/054782

§ 371 (c)(1),
(2), (4) Date: Apr. 16, 2007

(87) PCT Pub. No.: WO2006/032699

PCT Pub. Date: Mar. 30, 2006

(65) Prior Publication Data

US 2007/0257060 A1 Nov. 8, 2007

(30) Foreign Application Priority Data

Sep. 25, 2004 (EP) ..... 04255869

(51) Int. Cl.
*B67B 1/00* (2006.01)

(52) U.S. Cl. ..... 222/153.13; 222/153.14; 222/321.7; 222/321.9; 222/341

(58) Field of Classification Search ..... 222/321.9, 222/341, 321.7, 321.8, 153.13, 153.04, 153.14, 222/384

See application file for complete search history.

(56) References Cited

U.S. PATENT DOCUMENTS

| | | | | |
|---|---|---|---|---|
| 4,340,158 | A * | 7/1982 | Ford et al. | 222/153.13 |
| 4,991,746 | A * | 2/1991 | Schultz | 222/153.13 |
| 5,405,057 | A | 4/1995 | Moore | |
| 5,725,128 | A * | 3/1998 | Foster | 222/153.13 |
| 6,206,245 | B1 | 3/2001 | Bonningue | |
| 6,726,064 | B2 * | 4/2004 | Bonningue | 222/321.9 |
| 6,866,167 | B2 * | 3/2005 | Bougamont | 222/321.7 |

FOREIGN PATENT DOCUMENTS

| | | |
|---|---|---|
| WO | WO-0187494 | 11/2001 |

* cited by examiner

*Primary Examiner*—Frederick C. Nicolas
(74) *Attorney, Agent, or Firm*—Gifford, Krass, Sprinkle, Anderson & Citkowski, P.C.

(57) ABSTRACT

A dispensing pump for liquid or pasty products having a pump chamber (2) and a piston (6) arranged to move telescopically within the pump chamber between rest and active positions, wherein an inlet valve (5) is provided at one end of the pump chamber. This inlet valve may be locked closed with the piston in its rest position.

20 Claims, 5 Drawing Sheets

DISPENSING PUMP

FIELD OF THE INVENTION

The present invention relates to a manually operated dispensing pump for a container, such as those used to dispense liquid or pasty products, like liquid soap, hand cream or foodstuffs like ketchup and sauces. In particular, the invention provides a low cost dispensing pump, which is economical to manufacture and easy to assemble. All the pump components may be moulded from a plastics material, using conventional injection or compression moulding techniques, for example.

BACKGROUND OF THE INVENTION

Conventional dispensing pumps comprise a main body or housing, which defines a pump chamber and is held captive in the neck of a container by a collar. A piston is arranged to move telescopically within the pump chamber between a rest position and an active position. In the rest position, the piston is typically fully extended away from the pump chamber with no force acting on it other than that provided by a biasing spring. Once the pump has been primed, the rest position is typically associated with reduced pressure in the pump chamber. In the active position, a user applies force to move the piston in towards the pump chamber such that the spring is compressed and the pressure within the pump chamber is increased.

The free end of the piston (exposed outside the pump chamber) engages with a separate spout. The piston has a central dispensing passageway, which connects with the dispensing passageway through the spout. The spring provided in the pump chamber to return the piston (and hence the spout) to its rest position after dispensing is typically helical.

Finally, the pump comprises an inlet valve in the pump chamber and an outlet valve in the dispensing passageway in the piston. The inlet valve allows product to flow from the container into the pump chamber but prevents return flow from the pump chamber into the container. The outlet valve allows product to flow from the pump chamber through the spout but prevents return flow of product or air into the pump chamber.

In the simplest conventional dispensing pumps, for instance as described in U.S. Pat. No. 5,405,057, the inlet valve comprises a ball bearing, which engages in a seat around the inlet to the pump chamber from the container. When a reduced pressure is formed in the pump chamber, by the action of the piston, product is drawn into the pump chamber from the container, lifting the ball bearing off the valve seat. Further, when the piston is depressed in order to dispense the product from within the pump chamber via the spout, the ball bearing is forced back down against the inlet valve by the increased pressure created in the pump chamber. As the ball contacts the inlet valve it seals the inlet valve, so that product does not merely re-enter the container from which it first came, but rather, is forced through the outlet valve. In order for this ball bearing to operate properly it must be maintained in a position close to the inlet valve but be able to move from a sealing position over the inlet valve to an unsealing position away from the valve. This is often achieved by means of the same helical spring used to bias the piston to its rest position, acting as a cage to contain the ball bearing. This cage effect is further enhanced by the cross-section of the spring being varied such that it narrows a little way above the ball bearing to an extent that it is narrower than the diameter of the ball bearing. This thus creates a cage within which the ball bearing may have a limited amount of room to move. It should be stressed that the spring is not used to bias the ball bearing closed against the valve under typical operating conditions.

The outlet valve is provided by another ball bearing, which engages in a valve seat defined in the dispensing passageway in the piston. The ball bearing is inserted into the dispensing passageway in the piston before the spout is assembled thereto and is then retained in the piston dispensing passageway by the spout. The spout is provided with engagement means for connecting it to the piston, and is adapted to restrain the ball bearing within the piston dispensing passageway. As the product is forced out of the pump chamber, the outlet valve ball bearing lifts off its valve seat, allowing product to pass through the dispensing passageway to the spout, where it is dispensed to the user. When product is drawn into the pump chamber from the container by the reduced pressure in the pump chamber, the outlet valve ball bearing is sucked back against its valve seat, preventing air or any product remaining in the spout from being drawn back into the pump chamber. It should be stressed that there is no external force biasing the ball bearing against the outlet valve seat under typical operating conditions, other than gravity and the suction created by reduced pressure in the pump chamber which is itself created during the movement of the piston from the active position to the rest position.

Due to the inlet and outlet ball bearings not being biased against their respective valve seats a problem arises in that with the piston/spout in the rest position it is possible for product to flow from the container, through the inlet valve into the pump chamber, through the outlet valve and out of the spout, under certain conditions. These conditions could be if the dispenser is lying on its side or is upside down, or possibly under reduced pressure conditions such as in the hold of an aircraft at high altitude. Accordingly, product can leak from the dispenser thus causing inconvenience.

Attempts have been made to overcome this problem of leakage by locking the inlet ball bearing against the inlet valve. In U.S. Pat. No. 5,405,057 this is described as being achieved by being able to lock the piston in the fully active and depressed position. When in this position the spring is compressed to such an extent that the portion of the spring which has the narrower cross-section is forced downwards so that it pushes the ball bearing against the inlet valve. One way of locking the piston in this depressed position is to have mutually cooperating screw threads located on the collar and the spout. Alternatively, mutually cooperating projections, or slots and associated projections would achieve the same result.

Although the above described locking feature works well with metallic springs which regain their shape even after relatively prolonged periods of compression, it does not work well with springs that are made of plastic which suffer from so-called "creep".

SUMMARY OF THE INVENTION

International application WO 0187494, belonging to the present applicants, describes a pump dispenser with such a plastic spring and accordingly it is the purpose of this invention to provide a solution to the above described problem of leakage without causing creep of the spring. In other words it is an object of the present invention to lock the inlet ball valve in a closed position without compression of the biasing spring. In one aspect there is provided a dispensing pump for a container, the pump comprising a housing, held fixed in relation to the container and defining a pump chamber in communication with the inside of the container, a spout, arranged to move telescopically with respect to the housing between a rest position and an active position, a spring, arranged to return the spout from its active position to its rest position, an inlet valve, adapted to prevent air entering the container but to allow product to enter the pump chamber from the container, and an outlet valve, adapted to prevent air entering the pump chamber but to allow product to be dispensed from the pump chamber through the spout, wherein the pump further comprises means for locking the inlet valve in a closed position when the spout is in its rest position.

With the known dispensers, described above, if the user wishes to lock the inlet valve he has to depress the piston such that it reaches the active position. However, on doing this, any product that is already within the pump chamber will be dispensed. It may be that the user does not wish to use any of the product at this time and accordingly this product is thus wasted. One advantage of the present invention is that this wastage does not occur since the inlet valve may be locked with the piston in the rest position without the need to depress the piston to the active position.

Further embodiments are disclosed in the dependent claims attached hereto.

BRIEF DESCRIPTION OF THE DRAWINGS

The present invention and its advantages will be better understood by referring, by way of example, to the following detailed description and the attached Figures, in which.

DETAILED DESCRIPTION OF THE PREFERRED EMBODIMENTS

Figure 1:
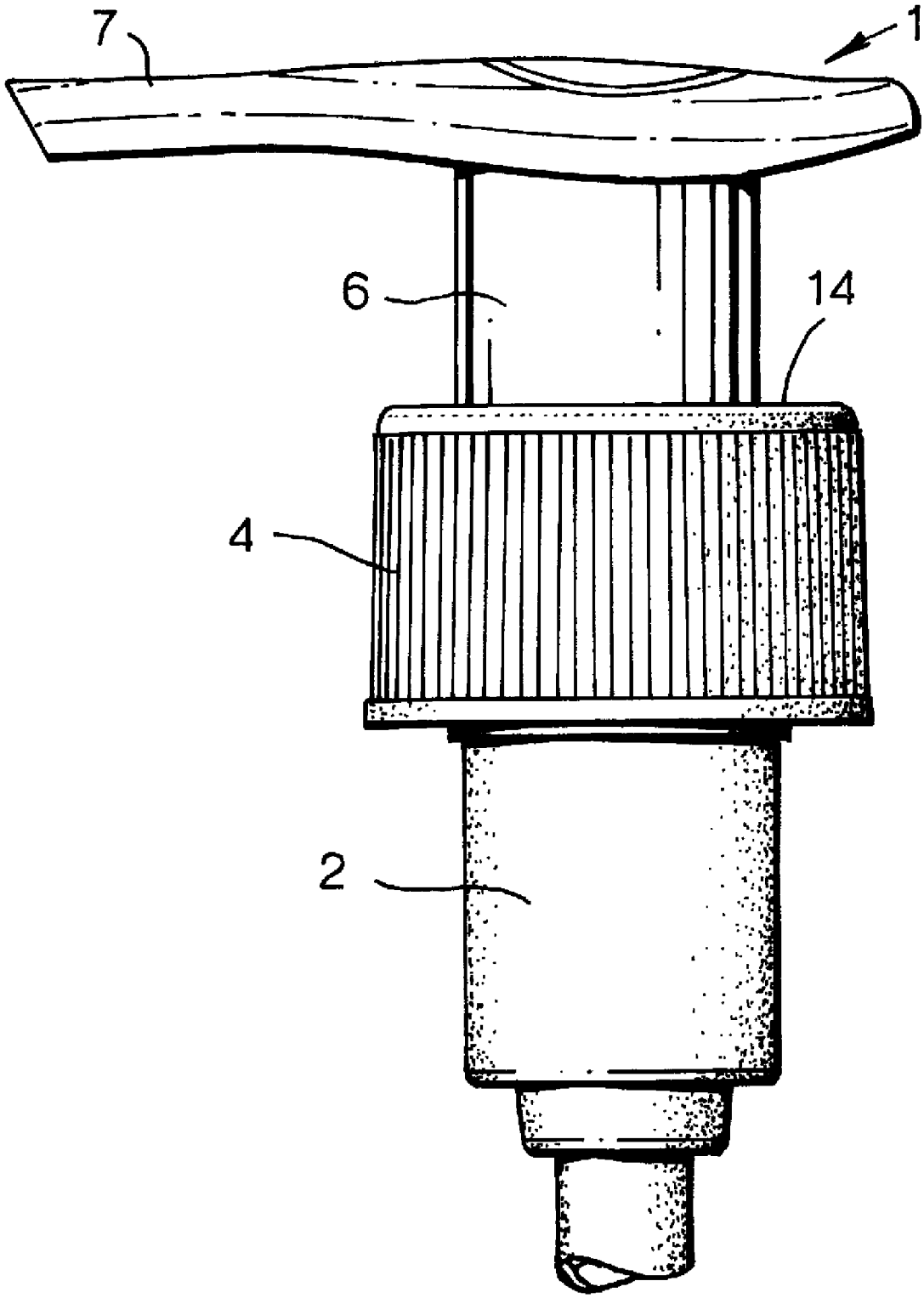
FIG. 1 shows an external side view of a dispensing pump.

Wherever possible, like components in the drawings have been given the same reference numerals.

Referring to FIG. 1, a dispensing pump 1 comprises a main body or housing, of approximately cylindrical shape, acting as a pump chamber 2. The housing is held fixed in the neck of a container (not shown) by a collar 4. The collar 4 may have a screw thread, which is adapted to engage with a complimentary screw thread on the container.

A piston 6, which at its upper end is connected to a spout 7, through which product from within the container may be dispensed, is arranged to move telescopically within the pump chamber 2 between rest and active positions (as defined above).

Figure 2:
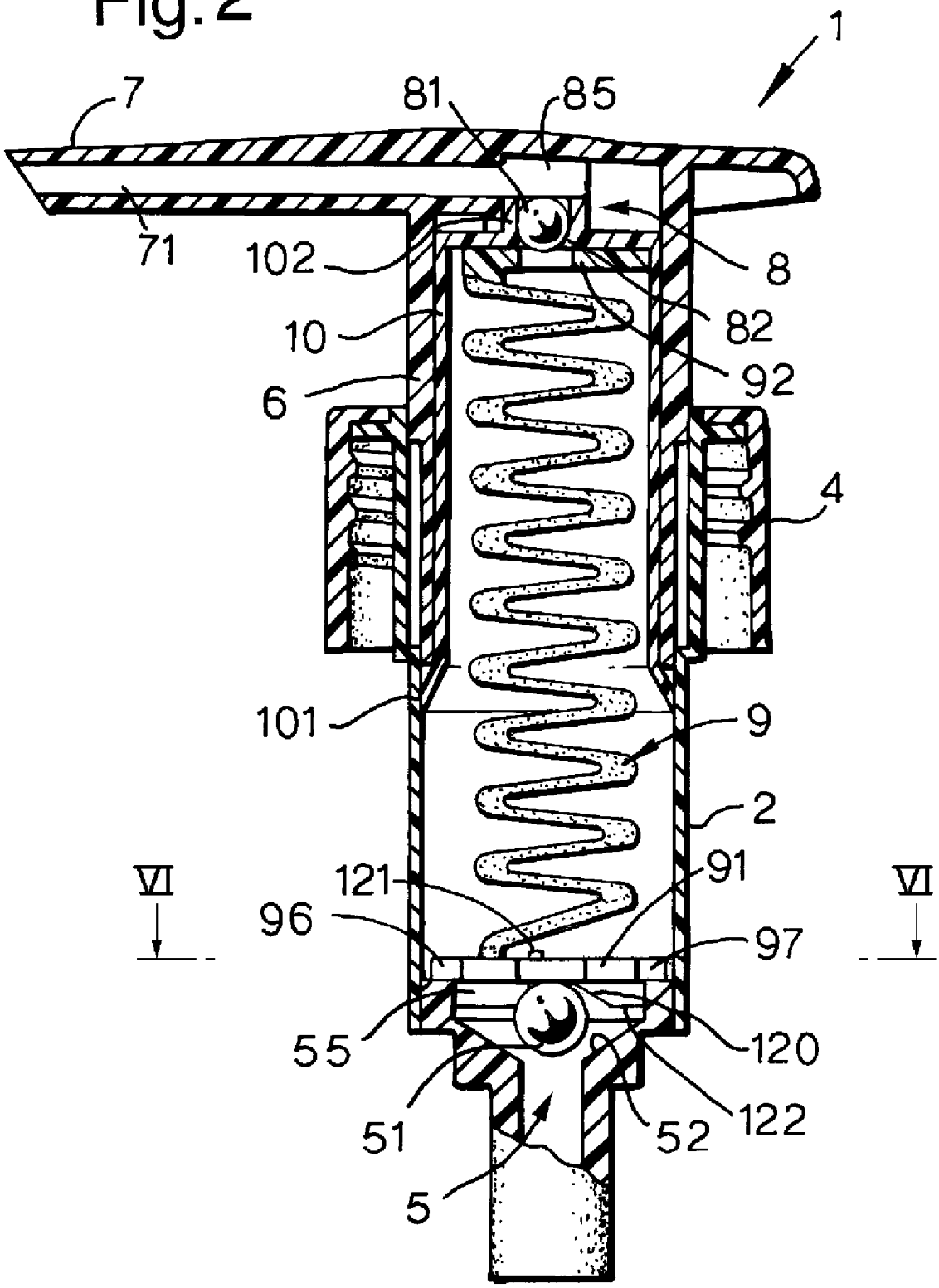
FIG. 2 shows a cross-section view of a dispensing pump, with the inlet valve open. This cross-section is taken on the line II-II of FIG. 6 and shows the spring and lower end plate in elevation.

Referring now to FIG. 2, it may be seen that inside the piston 6 a tubular seal 10 is arranged. The seal 10 press fits inside the piston 6 and provides a seal between the moving piston 6 and the side wall of the pump chamber 2. It also defines a valve seat 82 for an outlet valve 8. The tubular seal 10 has a flexible skirt 101, which extends below the free end of the piston 6 and flares radially outwardly, to conform to the side wall of the pump chamber 2 and form a fluid seal therewith. The tubular seal 10 also comprises a chimney 102 adjacent to the valve seat 82, which extends into the dispensing passageway 71 in the spout 7 and restrains a valve member 81 within an outlet valve chamber 85, defined in the spout 7.

This valve member 81 may be a ball bearing which may be made of metal or a plastics material. It seats against the valve seat 82 to prevent air being drawn into the pump chamber 2 under the action of the reduced pressure created therein when the dispenser is used in the manner described above in relation to the prior art.

At the base of the pump chamber 2, directed towards the inside of the container, a valve seat 52 for an inlet valve 5 is defined. A second valve member 51, such as a ball bearing which may also be made of metal or a plastics material, seats against the valve seat 52 to prevent air or product entering the container from the pump chamber 2.

Inside the housing a spring 9 is provided to return the spout 7 to its rest position after operation of the pump. The spring 9 is made from a plastics material and has a folded, concertina configuration. The lower end of this spring 9 has a planar end plate 91 with a corresponding planar end plate 92 at the upper end.

In the region of the inlet valve 5, an inlet valve chamber 55 is defined by the walls of the pump chamber 2 and the valve seat 52 respectively, with the lower end plate 91 partially occluding the open end of the valve chamber 55 and retaining the valve member 51 therein.

Figure 5:
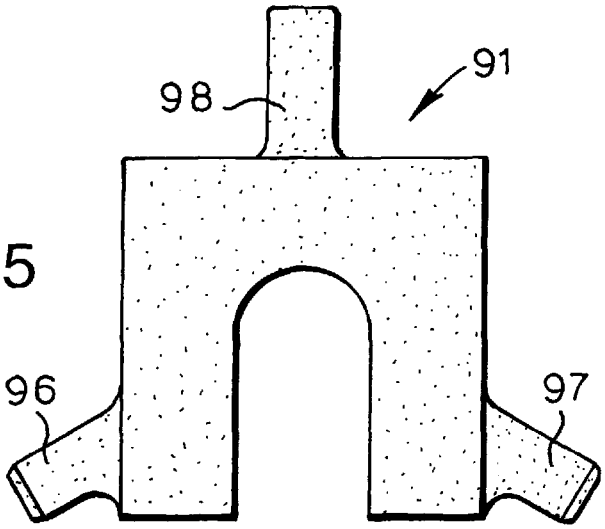
FIG. 5 shows a plan view of an end plate.

Referring to FIG. 5, the lower end plate 91 is shown in plan view. It can be seen that there are three arms 96,97,98 extending radially outwards from the end plate 91. These three arms are arranged equally spaced about the end plate 91 and of such length that their distal ends (the ends furthest from the centre of the plate 91) all lie on the circumference of an imaginary circle which has a diameter which is approximately equal to, or slightly less than, the internal diameter of the pump chamber 2.

Referring to FIGS. 2, 3, 6 and 7, it may be seen that at the lower end of the pump chamber 2, towards the inlet valve 5, three ramps 120 lie against, but radially inward of, the pump chamber's walls. These ramps are spaced equally around the circumference of the internal diameter of the pump chamber 2.

Figure 6:
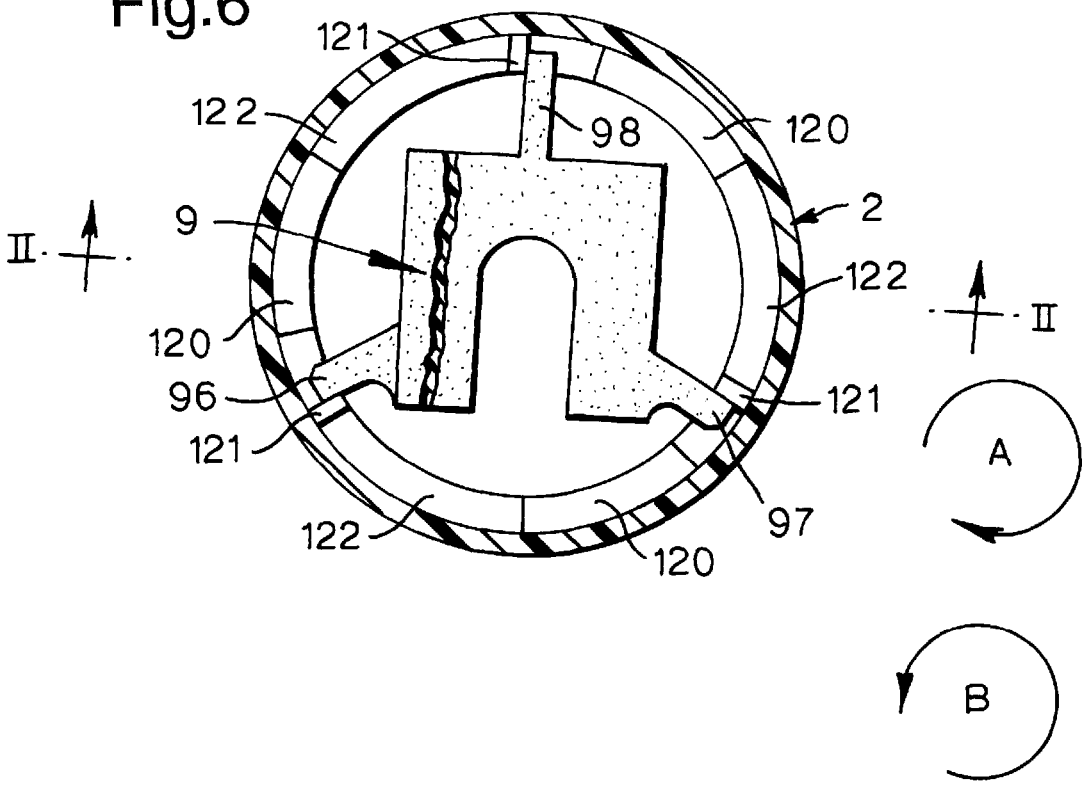
FIG. 6 shows a horizontal cross-section through the pump taken on the line VI-VI on FIG. 2.
Figure 7:
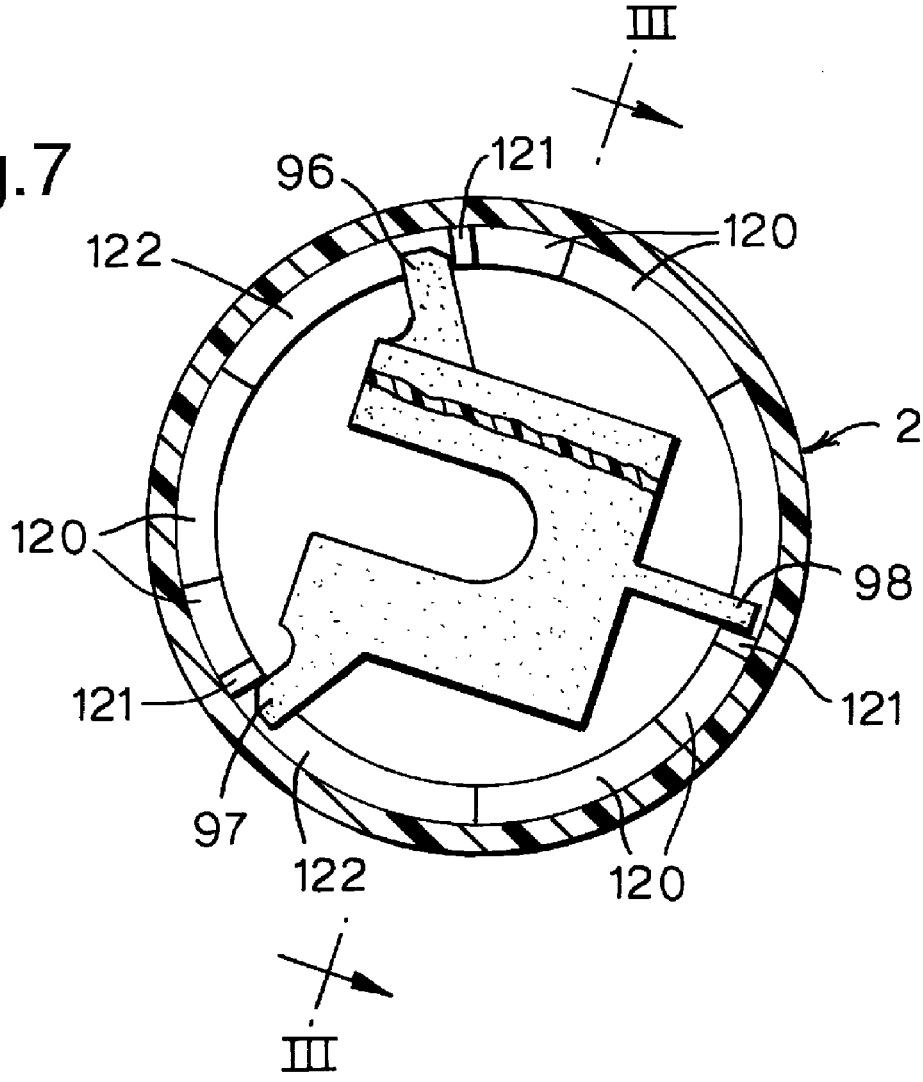
FIG. 7 shows a horizontal cross-section through the pump taken on the line VII-VII on FIG. 3.

FIGS. 6 and 7 show sectional views of the pump taken above the lower end plate 91 and looking downwards. It may be seen that each ramp 120 occupies a sector of approximately 60 degrees. At one end of each ramp is a wall 121 which extends towards the upper end of the pump chamber 2. At the other end of each ramp is a level plane 122 perpendicular to the axis of the pump chamber 2 lying in a sector approximately equal to 60 degrees. Each level plane 122 ends at the adjacent wall 121.

The end plate 91 is positioned in the pump chamber 2 such that each arm 96,97,98 occupies one sector respectively. The spring 9 biases the plate 91 and its arms 96,97,98 towards the lower end of the pump chamber 2.

When a user wishes to dispense product from the container the plate must be rotated, if necessary, so that each arm 96,97,98 is resting on the upper side and at the top of each ramp 120. This is achieved by rotation of the spout 7, which co-operates with the upper plate 92, which is connected to the spring 9, which is connected to the lower plate 91. To move the arms 96,97,98 so that they are at the upper end of the ramps the spout is rotated anti-clockwise, when viewed from above, (see "B" in FIG. 6). The walls 121 prevent the arms 96,97,98 moving past the upper end of the ramps 120.

By locating the arms 96,97,98 in this position, the end plate 91 is raised above and away from the inlet valve 5 so that the inlet valve member 51 may move freely away from and towards the inlet valve seat 52, depending on the pressure within the pump chamber 2, and thus allow the pump dispenser to operate correctly. Since the plate 91 is held away from the inlet valve 5, it restrains the resilience of the spring 9 from acting on the inlet valve member 51.

When the user wishes to lock the inlet valve 5 to prevent leakage the spout 7 must be rotated clockwise (refer to "A" in FIG. 6) so that the lower end plate 91 is rotated correspondingly. The arms 96,97,98 slide over and down the ramps 120 (under the biasing of the spring 9) and along the level planes 122 until they are prevented from further rotation by each wall 121.

Figure 3:
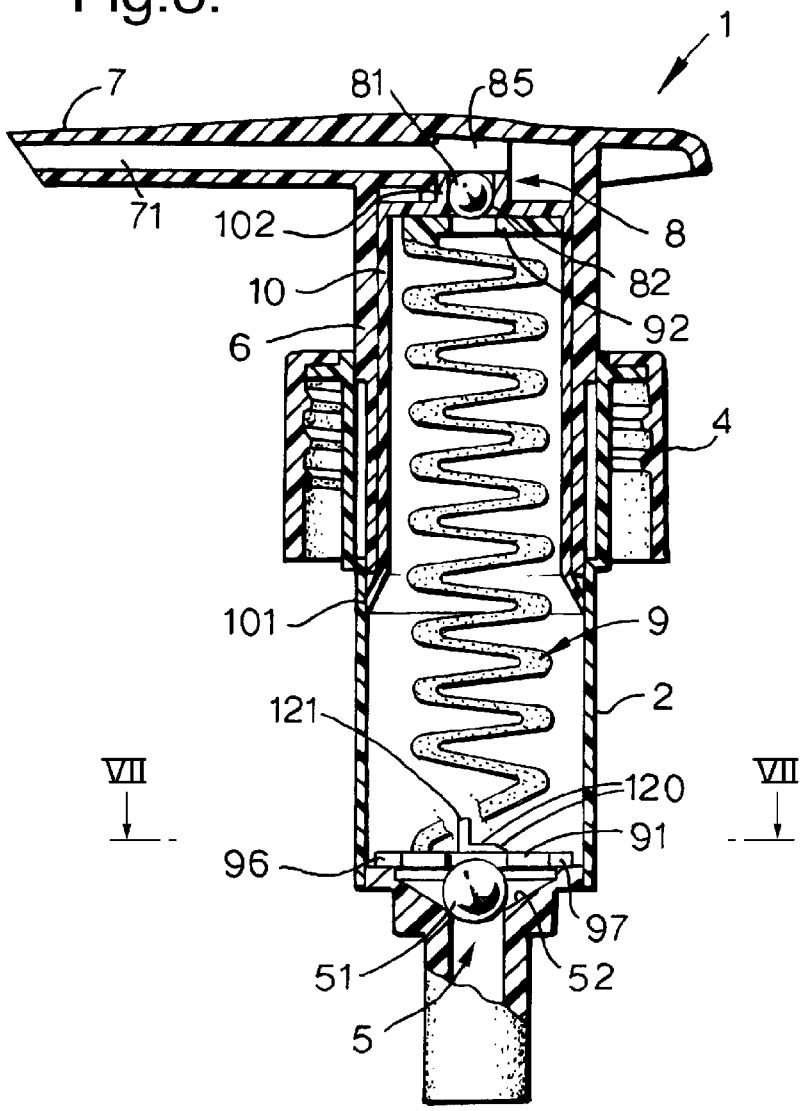
FIG. 3 shows a cross-section view of a dispensing pump, with the inlet valve locked closed. This cross-section is taken on the line III-III of FIG. 7 and shows the spring and lower end plate in elevation.
Figure 4:
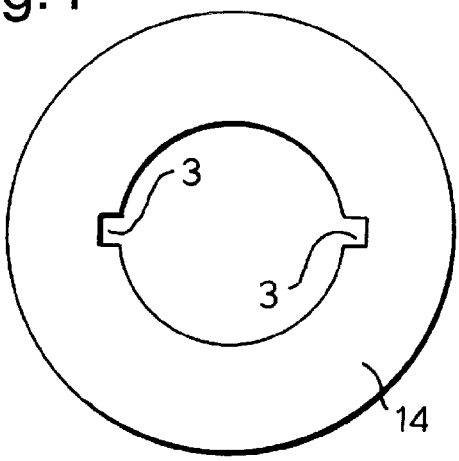
FIG. 4 shows a plan view of a collar with locking slots.

FIG. 7 shows a horizontal cross-section of the dispenser with the plate 91 in this fully-clockwise rotated position, and FIG. 3 shows a vertical cross-section of the dispenser with the end plate 91 in this position.

In FIG. 3, the inlet valve member 51 is held against the inlet valve seat 52 by the end plate 91, which is correspondingly held in place by the force of the spring 9, so that the valve member 51 cannot lift off the inlet valve 5. Accordingly, fluid held within the dispenser cannot pass through the inlet valve and thus leakage is prevented.

By rotating the spout 7 in the clockwise direction (when viewed from above) the spout is also locked in the up-position so that it may not be depressed and activate the piston 6.

This is achieved by the presence of two projections (not shown) on the radially outer surface of the piston 6, which in the unlocked position (i.e. with the spout in the fully anti-clockwise direction, "B" in FIG. 6) are allowed to slide up and down, with the movement of the piston, in two corresponding slots 3 in a washer 14. However, with the spout in the locked position, the two projections are rotated out of alignment with these slots 3, such that the projections, in conjunction with the washer 14, prevent movement of the piston.

Washer 14 is of plate-like shape and is adhered to the housing by such means as welding. Alternatively, the washer 14 could be moulded with the housing in-situ. When the collar 4 is affixed to a container the underside of the top edge of the collar 4 seals against the upper side of the washer 14.

Although in the embodiment depicted in the Figures and described above the lower end plate 91 has three arms 96,97, 98 and three associated ramps 120 it would be readily understood by those skilled in the art that more or less than three arms and ramps would also be possible.

Further, although the above described invention is aimed at overcoming the problem of creep associated with plastic springs, it will be apparent that it could also be directed to use with conventional metal springs and is therefore not limited to the former type of spring.

The invention claimed is:

1. A dispensing pump (1) for a container, the pump comprising:

a pump chamber (2) held fixed in relation to the container and in communication with the inside of the container;

a spout (7) arranged to move telescopically with respect to the pump chamber (2) between a rest position and an active position;

a spring (9) arranged to return the spout (7) from its active position to its rest position;

an inlet valve (5) adapted to prevent air entering the container but to allow product to enter the pump chamber (2) from the container; and an outlet valve (8), adapted to prevent air entering the pump chamber (2) but to allow product to be dispensed from the pump chamber (2) through the spout (7), characterised in that;

the pump (1) further comprises means (91) for locking the inlet valve (5) in a closed position when the spout (7) is in its rest position.

2. A dispensing pump (1) according to claim 1, wherein the locking means comprises an end plate (91) which co-operates with both the spring (9) and the inside of the pump chamber (2), such that when the spring (9) is rotated with respect to the longitudinal axis of the pump chamber (2) between a first position in which the inlet valve is open to a second position, the end plate is moved towards the inlet valve (5) by the spring to lock the inlet valve in its closed position.

3. A dispensing pump (1) according to claim 2, wherein the spout (7) co-operates with the spring (9) such that when the spout (7) is rotated, the spring (9) also rotates.

4. A dispensing pump (1) according to claim 2, wherein the end plate (91) has at least one arm (98) extending radially therefrom, and the inside of the pump chamber (2) has at least one ramp (120) which the at least one arm engages as the spring (9) is rotated from its second position back to its first position to move the end plate (91) away from the inlet valve (5) against the action of the spring (9).

5. A dispensing pump (1) according to claim 2, wherein the end plate (91) has three arms (96,97,98) extending radially therefrom, and the inside of the pump chamber (2) has three ramps (120) which the three arms (96,97,98) engage.

6. A dispensing pump (1) according claim 1, further comprising a locking arrangement (3) to prevent movement of the spout (7) relative to the pump chamber (2), wherein the locking arrangement is adapted to lock the spout (7) in its rest position.

7. A dispensing pump (1) according claim 2, further comprising a valve member (51), which co-operates with the said end plate (91) and an inlet valve seat (52), whereby to effect the said first and second positions.

8. A dispensing pump (1) according to claim 7, wherein in the said first position the end plate (91) is held away from the inlet valve (5) so that the inlet valve member (51) can move freely away from and towards the inlet valve seat (52).

9. A dispensing pump (1) according to claim 8, wherein the resilience of the spring (9) is restrained from acting on the inlet valve member (51).

10. A dispensing pump (1) according to claim 7, wherein in the said second position the inlet valve member (51) is held against the inlet valve seat (52) by the end plate (91) so that the valve member (51) cannot lift off the inlet valve (5).

11. A dispensing pump for a container, the pump comprising:

a pump chamber held fixed in relation to the container and in communication with the inside of the container;

a spout arranged to move telescopically with respect to the pump chamber between a rest position and an active position;

a spring arranged to return the spout from its active position to its rest position;

an inlet valve adapted to prevent air entering the container but to allow product to enter the pump chamber from the container;

an outlet valve, adapted to prevent air entering the pump chamber but to allow product to be dispensed from the pump chamber through the spout; and a lock mechanism which, upon actuation, locks the inlet valve in a closed position while the spout is in said rest position.

12. A dispensing pump according to claim 11, wherein the lock mechanism comprises an end plate which co-operates with both the spring and the inside of the pump chamber, such that when the lock mechanism is actuated by rotation of the spring relative to the longitudinal axis of the pump chamber between a first position in which the inlet valve is open to a second position, the end plate is moved towards and against the inlet valve by the spring to lock the inlet valve in its closed position.

13. A dispensing pump according to claim 12, wherein the spout co-operates with the spring such that when the spout is rotated, the spring also rotates.

14. A dispensing pump according to claim 12, wherein the end plate has at least one arm extending radially therefrom, and the inside of the pump chamber has at least one ramp which the at least one arm engages as the spring is rotated from its second position back to its first position to move the end plate away from the inlet valve against the action of the spring.

15. A dispensing pump according to claim 12, wherein the end plate has three arms extending radially therefrom, and the inside of the pump chamber has three ramps which the three arms engage.

16. A dispensing pump according claim 11, further comprising a locking arrangement to prevent movement of the spout relative to the pump chamber, wherein the locking arrangement is adapted to lock the spout in its rest position.

17. A dispensing pump according claim 12, further comprising a valve member, which co-operates with the said end plate and an inlet valve seat, whereby to effect the said first and second positions.

18. A dispensing pump according to claim 17, wherein in the said first position the end plate is held away from the inlet valve so that the inlet valve member can move freely away from and towards the inlet valve seat.

19. A dispensing pump according to claim 18, wherein the resilience of the spring is restrained from acting on the inlet valve member.

20. A dispensing pump according to claim 17, wherein in the said second position the inlet valve member is held against the inlet valve seat by the end plate so that the valve member cannot lift off the inlet valve.

* * * * *